US007970146B2

(12) United States Patent
Baechler

(10) Patent No.: US 7,970,146 B2
(45) Date of Patent: Jun. 28, 2011

(54) LEARNING BY PROVOCATION

(75) Inventor: Herbert Baechler, Meilen (CH)

(73) Assignee: Phonak AG, Staefa (CH)

( * ) Notice: Subject to any disclaimer, the term of this patent is extended or adjusted under 35 U.S.C. 154(b) by 1377 days.

(21) Appl. No.: 11/458,738

(22) Filed: Jul. 20, 2006

(65) Prior Publication Data

US 2008/0019547 A1 Jan. 24, 2008

(51) Int. Cl.
*H04R 29/00* (2006.01)
*H04R 25/00* (2006.01)

(52) U.S. Cl. ..... 381/60; 381/312

(58) Field of Classification Search ..... 381/60, 381/312, 321
See application file for complete search history.

(56) References Cited

U.S. PATENT DOCUMENTS

| | | | | |
|---|---|---|---|---|
| 7,340,074 | B2 * | 3/2008 | Chalupper | 381/312 |
| 2003/0123685 | A1 | 7/2003 | Basseas | |
| 2004/0208331 | A1 | 10/2004 | Chalupper | |

FOREIGN PATENT DOCUMENTS

| | | | |
|---|---|---|---|
| EP | 1617705 | A2 | 1/2006 |
| WO | 2004/004414 | A1 | 1/2004 |

OTHER PUBLICATIONS

International Search Report dated May 7, 2007.

* cited by examiner

*Primary Examiner* — Brian Ensey
(74) *Attorney, Agent, or Firm* — Pearne & Gordon LLP

(57) ABSTRACT

To improve the adjustment of the settings of a hearing aid or a hearing instrument respectively, a method is proposed according to which at least one setting of the hearing aid or instrument respectively for a particular acoustic environment is changed or deviated from the actual setting without any preceding action or manipulation of the user to provoke the user to interact or to readjust the setting.

15 Claims, 1 Drawing Sheet

LEARNING BY PROVOCATION

TITLE OF THE INVENTION

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

BACKGROUND OF THE INVENTION

1. Field of the Invention

Figure 1:
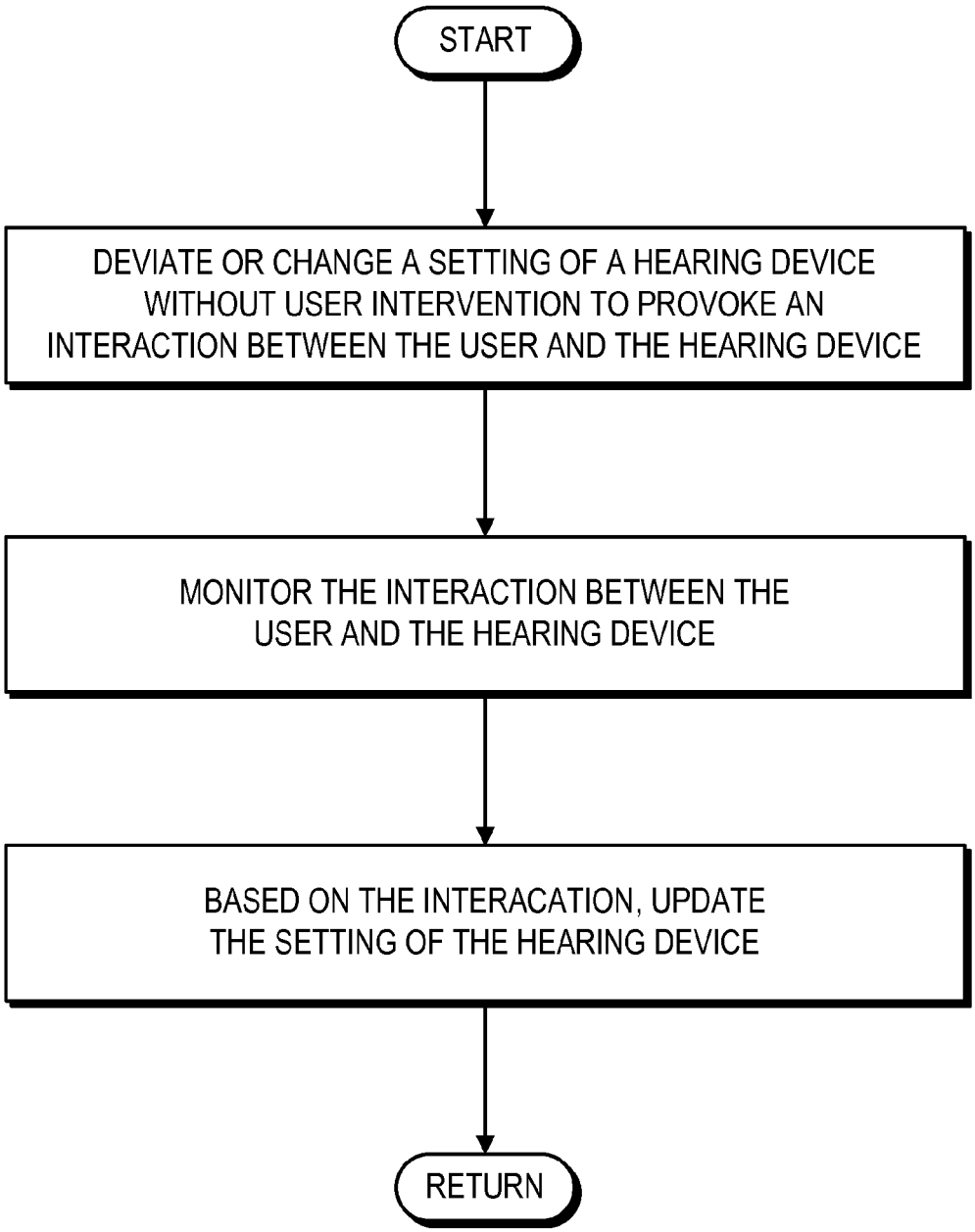

The present invention refers to a method such as that illustrated in FIG. 1, for example, for the adjustment of settings of a hearing aid and to a hearing aid comprising software to implement a method for the adjustment of settings of the aid.

2. Description of Related Art Including Information Disclosed Under 37 CFR 1.97 and 1.98

So called self-learning hearing aids are known, where the adaptation of optimized settings is automatically executed by the hearing aid itself.

A drawback or problem exists in recognising valid or true modifications made by the user.

No modifications of the settings for a long period does not explicitly means, that the user is happy with the respective settings. It might well be, that the user is not familiar with the manipulation of settings of the hearing aid or the settings are such, that the user can live with the settings but they are not optimized.

Today's high end hearing instruments incorporate sophisticated schemes to automatically adjust the instrument parameters to specific acoustic environments. They hereby provide optimized sound qualities and speech perception in all situations. The current techniques have still some drawbacks in terms of fulfilling individual needs and preferences of the hearing instrument users, as mentioned above. In order to get more insight to these individual requirements data logging has become an interesting tool while reporting all the users' interactions with the hearing instruments to the fitter. There are existing hearing aids, which can automatically analyse the data log stored in the non-volatile memory of the hearing instrument and provide some changes to the current settings. The fitter can either accept the proposed modifications or make changes him/herself. Most of the times these modifications yield to an improved comfort for the hearing instrument users since interactions with the hearing instrument tend be needed less often than prior to the modified adjustments.

It is a disadvantage of the current actual solutions that modifications have to be done either by the fitter or audiologist since the user can't neither reprogram the hearing aid himself/herself nor allocate the hearing instrument to update its setting based on frequent user interactions. To overcome these shortcomings the hearing instrument should learn out of user interactions and optimize settings automatically, "User preference learning" has yet been developed. Data logging is still the basic tool for the procedure; learning algorithms will exploit the data gathered over time within different acoustical environments. The results are now interpreted in the hearing instrument and directly applied, a visit of the fitter or audiologist is no more needed and this is a great advantage.

This improved method still has some drawbacks; the performance and validity of the embedded learning rules depends to a large extend on user interactions. The more interactions there are the faster and better learning converges. A couple of single interactions would not really train the system efficiently. Since hearing instruments incorporate different programs, training has to be done for all accordingly. It might therefore take long until the user gets a real benefit out of his/her self-learning hearing instrument and this must be overcome.

In addition many changes in settings made by the user does not automatically mean, that the initial settings were bad. Vice versa as stated above no changes in settings does not automatically means, that the settings are good.

BRIEF SUMMARY OF THE INVENTION

Several Ways to Intensivate and Shorten the Learning/Training Process of an Intelligent Hearing Instrument can be Described:

- A special acoustical training parcour could be defined, which would present a large variety of significant real life situations to a hearing instrument user, while he/she is continuously adjusting the hearing instrument accordingly. Such a training parcour could be provided on a CD, MP3 file/player or alike. In a couple of minutes/hours the hearing instrument would be trained instead of weeks/months and hereby individually optimized much faster. Although a lot of realistic acoustical sounds and environments could be played through by the mentioned procedures, differences between the simulated and fully natural situations would remain. The quality of the respective sound presentation via loudspeaker will influence the outcome and validity of the training sequence.
- Training in the real world is much preferred. It is therefore an object of the present invention to describe a method applicable in the real world, still shorten the learning time and increase the amount of user interactions to the level needed to reliably estimate optimal individual settings of the crucial parameters.

It is a further object of the present invention to propose a solution or method respectively for an improved adjustment of settings of a hearing aid or hearing instrument respectively by using a increased amount of setting changes initiated by the user due to non optimal settings of the hearing aid giving the user the possibility for improved adjustment without the need of consulting an audiologist or fitter respectively.

It is furthermore an object of the present invention to provide a hearing aid or hearing instrument respectively suitable for improved adjustments of hearing instrument settings by learning algorithms where optimal adjustments can be achieved within shortened period.

DRIEF DESCRIPTION OF THE SEVERAL VEWS OF THE DRAWING(S)

FIG. 1 shows a flow diagram illustrating an embodiment of a method for the improved adjustment of the settings of a hearing aid or a hearing instrument.

DETAILED DESCRIPTION OF THE INVENTION

According the inventive method for the improved adjustments of settings of a hearing instrument or hearing aid respectively it is proposed, that at least one setting of the hearing aid for a particular acoustic environment is changed or deviated from the actual setting without any preceding action or manipulation of the user to provoke the user to interact or readjust e.g. said setting.

This provocation could be a change in volume, output level, spectral shape, distortions (feedback-canceller), noise cleaning (noise canceller, beamformer), program or any other significant alteration within the actual acoustical environment. If the user would not interfere, the change would not be significant, thus informative for the learning sequence as well. On the other hand it might well be, that the user was not aware about the deviation or was not in a position to react within a reasonable time period. With other words it might well be, that the deviation from the actual setting has to be repeated to again provoke an interaction by the user.

The repetition of the provocation can be either an additional deviation or a repetition of the original deviation, which means that before repetition of the provocation the settings will be reset.

The provoked interaction of the end-user either can e.g. be a change on exactly the same parameter the hearing aid has changed or can consist in simply accepting or declining the change. In the latter case the scope of parameters on which provocation learning can be applied is much broader than in the first case, because it is not necessary that the hearing aid's end-user interface offers direct access to the changed parameter.

The user could be informed about the special behaviour of the hearing instrument so that he/she could stop the procedure in case of serious annoyance. However a blind experiment could be made as well, what ever is the more appropriate approach in praxis.

The provocation could be randomly out of the box or following some rules or templates which means the deviation or changes of the at least one setting for a particular acoustical environment could be changed randomly or according to a predetermined regular or irregular rule, algorithm, etc. The changes or deviations in settings may be depending on user responses or data memorized in the meantime of the learning period. Provocations strategies and rules can be derived from various tests of different user persons and using different algorithms, programs, etc. according which the deviations or changes of the settings of the hearing instrument are initiated.

For the adjustment of the settings of a hearing instrument at least one setting can be repeatedly changed or deviated from the proceeding settings for a particular acoustic environment and respective repeated interactions or readjustments done by the user can lead to a final optimized setting value, which can be stored within the hearing instrument as new basic optimized setting of the hearing aid for the mentioned particular acoustic environment.

According a further method it is possible, that after a change or deviation from the actual setting for a particular acoustic environment in case no interaction or readjustment is done by the user or is recognized by the hearing instrument it might by advisable to either repeat the deviation or change of the setting and/or to inform the user e.g. acoustically about the non recognized change of the settings.

Again furthermore it is possible that within the hearing instrument so called basic settings are stored which will remain unchanged while a so called actualized setting value for a particular acoustic environment is changed to provoke the user to interact and to readjust the user-setting while the basic device setting remains unchanged. Only if the user person is of the opinion, that the actualized setting or user setting is optimal the basic setting of the hearing instrument will be changed or adjusted respectively. It is further possible that the basic hearing instrument settings will be changed or adjusted only after restart of the hearing instrument. Therefore at least some of the individual settings of the hearing instrument each for a particular acoustic environment may comprise a basic setting value and an actualized setting value which latter is changed without the influence of the user to provoke the user to interact or adjust the respective user setting, the respective basic setting of the hearing instrument is only adjusted to the respective user setting upon activation by the user, an audiologist, a fitter and/or at restart of the device.

Again according a further proposed method the user could be informed about the change or deviation from the actual setting after a certain period, first of all asking the user, whether he recognized the change and if yes, if in case of a change or readjustment of the user setting the actual setting is improved, equivalent or worth compared with the initial setting.

One problem of course may occur, if the acoustic environment conditions change rapidly, so that one and the same setting can not be changed within a reasonable time period for a particular acoustic environment. It is therefore preferred, that changes of settings or deviations from actual settings will only be initiated in case, that the user will stay in more or less constant acoustic environments. Otherwise in case of rapid changes of acoustic environment any randomly initiated changes in settings should be neglected or reset to the initial settings.

The above mentioned and proposed inventive methods in principal are not only suitable for learning sequences within the instrument but they could be used to speed up the validation phase while triggering the user to actively interfere with the instrument and search for the best program or setting of the instrument in a given solution.

Furthermore according the present invention a respective software is proposed which enables a hearing instrument to apply the above mentioned method for improved adjustment of hearing aid settings for a particular acoustic environment. Preferred of course is a software which is applicable universally in most of the today used hearing aids or hearing instruments respectively at least for some of the settings used within a hearing instrument.

It is of course possible to incorporate such a software within the hearing instrument itself or within a remote control, which is installed e.g. within an ordinary tool daily used such as e.g. within a arm watch, a mobile telephone etc.

The invention claimed is:

1. Method for the improved adjustment of the settings of a hearing aid or a hearing instrument respectively characterised in that at least one setting of the hearing aid or instrument respectively for a particular acoustic environment is changed or deviated from an actual setting without any preceding action or manipulation of the user to provoke the user to interact or to readjust said setting.

2. Method according to claim 1 characterized in, that at least one setting after repeated changes and interactions or readjustments by the user is stored as a new basic setting of the hearing aid for a particular acoustic environment.

3. Method according to claim 1 characterized in, that after the change in the at least one setting, if no response, interaction or readjustment by the user is recognizable, a further change of the said setting is initiated to further provoke the user.

4. Method according to claim 1 characterized in, that the change in the at least one setting is a change in at least one of a volume, an output level, a spectral shape, distortions, or noise cleaning.

5. Method according to claim 1 characterized in, that the at least one setting for a particular acoustic environment is changed randomly.

6. Method according to claim 1 characterized in, that at least one of the settings of the hearing aid for each particular acoustic environment comprises a basic setting value and an actualized setting value wherein the actualized setting value is changed from the actual setting without the influence from the user to provoke the user to interact or to adjust a respective user setting and that the respective basic setting value of the device is adjusted to the respective user setting upon activation by the user, an audiologist, or a fitter.

7. Method according to claim 1, characterized in, that in case after a first change or deviation of the actual setting or a particular acoustic environment the user does not interact or no adjustment is recognisable a further change or deviation of the actual setting is initiated which is more dramatic than the first change or deviation of the actual setting or a different setting for the same acoustic environment is changed.

8. Method according to claim 1, characterized in that the provoked interaction of the end user is a change on exactly the same actual setting the hearing aid has changed.

9. A hearing instrument with an adjustable acoustical environment or a remote control for said hearing instrument programmed with computer-executable instructions to be executed for an improved adjustment of settings of the hearing instrument to initiate a change or deviation of at least one setting of the hearing instrument for a respective acoustic environment without a preceding action of manipulation of the user to provoke the user to interact or to readjust said setting.

10. Method according to claim 4, wherein the distortions are a feedback-canceller.

11. Method according to claim 4, wherein the noise cleaning is either a noise canceller or a beamformer.

12. Method according to claim 1, wherein the at least one setting for a particular acoustic environment is changed according to a predetermined rule or algorithm.

13. Method according to claim 6, wherein the device is adjusted to the respective user setting at the restart of the device.

14. Method according to claim 1 characterized in, that in case after a change or deviation of the actual setting or a particular acoustic environment the user does not interact or no adjustment is recognisable a further change or deviation of the actual setting is initiated which is an alarm signal that is given to the user to either provoke the user to interact or to readjust the respective setting to inform the user that a respective change in setting has been initiated.

15. Method according to claim 1, characterized in that the provoked interaction of the end user requires the user to simply accept or decline the change.

* * * * *

UNITED STATES PATENT AND TRADEMARK OFFICE

CERTIFICATE OF CORRECTION

PATENT NO. : 7,970,146 B2
APPLICATION NO. : 11/458738
DATED : June 28, 2011
INVENTOR(S) : Herbert Baechler It is certified that error appears in the above-identified patent and that said Letters Patent is hereby corrected as shown below:

Column 2, line 57, replace "DRIEF" with -- BRIEF --

Signed and Sealed this
Thirteenth Day of September, 2011

David J. Kappos

David J. Kappos
*Director of the United States Patent and Trademark Office*